US009133675B2

(12) United States Patent
Telfer

(10) Patent No.: US 9,133,675 B2
(45) Date of Patent: Sep. 15, 2015

(54) DOWNHOLE TOOL AND METHOD

(75) Inventor: George Telfer, Aberdeen (GB)

(73) Assignee: M-I Drilling Fluids UK Limited, Aberdeen, Aberdeenshire (GB)

( * ) Notice: Subject to any disclaimer, the term of this patent is extended or adjusted under 35 U.S.C. 154(b) by 795 days.

(21) Appl. No.: 13/303,891

(22) Filed: Nov. 23, 2011

(65) Prior Publication Data

US 2012/0132438 A1 May 31, 2012

(30) Foreign Application Priority Data

Nov. 25, 2010 (GB) ..... 1019984.2

(51) Int. Cl.
*E21B 34/06* (2006.01)
*E21B 23/04* (2006.01)

(52) U.S. Cl.
CPC ..... *E21B 23/04* (2013.01)

(58) Field of Classification Search
CPC . E21B 27/04; E21B 33/1293; E21B 33/1295; E21B 23/04
USPC ..... 166/212, 250.07, 120, 318, 319, 321, 166/322, 323, 324, 374, 382, 373, 383, 386, 166/121, 122, 126, 129, 134
See application file for complete search history.

(56) References Cited

U.S. PATENT DOCUMENTS

| | | | | |
|---|---|---|---|---|
| 2,674,199 | A * | 4/1954 | Page | 166/212 |
| 2,836,250 | A * | 5/1958 | Brown | 166/134 |
| 3,584,684 | A | 6/1971 | Anderson et al. | |
| 4,436,149 | A | 3/1984 | Edwards | |
| 5,070,941 | A | 12/1991 | Kilgore | |
| 6,896,064 | B2 | 5/2005 | Howlett et al. | |
| 8,555,983 | B2 * | 10/2013 | Palacios | 166/373 |

FOREIGN PATENT DOCUMENTS

CA 2437635 A1 2/2004

OTHER PUBLICATIONS

Search Report issued in British Application No. GB1019984.2; Dated Feb. 7, 2011 (5 pages).
Further Search Report issued in British Application No. GB1019984.2; Dated Apr. 16, 2011 (2 pages).

* cited by examiner

*Primary Examiner* — Jennifer H Gay
*Assistant Examiner* — George Gray

(57) ABSTRACT

A work string tool to be operably associated with a weight-set packer tool uses pressure applied by fluid circulated from the surface above the weight-set packer, to deploy a hydraulic hold-down anchor mechanism above the packer to reduce the risk of unsetting during a high pressure "positive" wellbore integrity test. An axial bore of a tool tubular body houses first and second inner sleeves, and is configured to accommodate independent axial movement of the sleeves to provide multiple fluid flowpath configurations through the tool which allow use of circulation fluid pressure to circulate a ball obturator to a valve seat in a sleeve when a configuration change is required to deploy or release the anchor mechanism.

7 Claims, 6 Drawing Sheets

DOWNHOLE TOOL AND METHOD

FIELD OF THE DISCLOSURE

Embodiments disclosed herein relate to a downhole tool adapted to be attached to a workstring intended for carrying out tasks in a wellbore, suitably a drill string. More particularly, embodiments disclosed herein relate to a downhole tool adapted for use in wellbore integrity test procedures.

BACKGROUND

In the drilling and production of oil and gas wells, it is typical to prepare a well bore in a target oil or gas-bearing formation using a drill string which is terminated by a drill bit. The drill string is rotated to remove formation ahead of the drill bit, to drill and thus form a wellbore, and to increase the depth of the well. The drill string has an axial throughbore throughout its length which provides a fluid circulation path through the string and BHA and back up the annulus around the string within the well bore.

Drilling mud or other fluid is pumped through the drill string to cool the drill bit, and to aid the passage of drill cuttings from the base of the well to the surface, via an annulus formed between the drill string and the wall of the well bore.

At fixed intervals, typically the drill bit is removed from the wellbore and a casing comprising lengths of tubular casing sections coupled together end-to-end is run into the drilled wellbore and cemented in place. A smaller dimension drill bit is then inserted through the cased wellbore, to drill through the formation below the cased portion, to thereby extend the depth of the well. A smaller diameter casing is then installed in the extended portion of the wellbore and also cemented in place. If required, a liner comprising similar tubular sections coupled together end-to-end may be installed in the well, coupled to and extending from the final casing section. Once the desired full depth has been achieved, the drill string is removed from the well and then a work string is run-in to clean the well. Once the well has been cleaned out, the walls of the tubular members forming the casing/liner are free of debris so that when screens, packers, gravel pack assemblies, liner hangers or other completion equipment is inserted into the well, an efficient seal can be achieved between these devices and the casing/liner wall.

It is important to determine whether there are any cracks, gaps or other irregularities in the lining of a well bore, or in the cement between tubulars which line a well bore, which may allow the ingress of well bore fluid into the annulus of the bore. It is also important that any irregularities in the well bore casing connections and cement bonds are identified and monitored to prevent contamination of the well bore contents.

It is normally difficult to determine whether there are any irregularities in the well bore casing connections and cement bonds as the hydrostatic pressure created by drilling fluid within the well bore prevents well bore fluid from entering the annulus of the bore. In order to overcome this difficulty it is known to the art to use downhole packers to seal off sections of a pre-formed well bore in order to test the integrity of the particular section of bore. One test carried out to identify any such irregularities is a so-called "in-flow" or "negative" test.

During an in-flow test a packer is included on a work string and run into a bore. The individual packer elements of the packer tool are expanded to seal the annulus between the well tubing (casing or lining) and tool in the well bore. Expansion or "setting" of the packer is usually achieved by rotating the tool relative to the work string and the set packer thereafter prevents the normal flow of drilling fluid in the annulus between the work string and well bore tubular. A lower density fluid is then circulated within the work string which reduces the hydrostatic pressure within the pipe. As a consequence of the drop in hydrostatic pressure, well bore fluid can flow through any cracks or irregularities in the lining of the well bore or over the top of the liner lap into the annulus of the bore. If this occurs, the flow of well bore fluid into the bore results in an increase in pressure which can be monitored. As a result it is possible to locate areas where fluid can pass into the well bore through irregularities in the structure of the bore and where repair of the cement or lining may be required. After testing, the bore may be "pressured up" to remove the well bore fluid from the bore and a heavy drilling fluid can be passed through the string to return the hydrostatic pressure to normal.

Typically, a separate trip is required to be made into the well to perform an in-flow or negative pressure test. This is because the conventional packer tools used are set by a relative rotation within the well bore. As many other tools are activated by rotation and indeed as the drill string itself would normally be rotated during this type of operation, it is likely that the packer would prematurely set. This problem has been overcome by the introduction of a weight-set packer. Such a weight-set packer, also referred to as a "compression-set packer", is disclosed in the Applicant's International Patent Application, publication number WO/0183938, now U.S. Pat. No. 6,896,064, which is hereby incorporated by reference. The packer is set by a sleeve moveable on a body of the packer being set down on a formation in the well bore. Movement of the sleeve compresses one or more packing elements to provide a seal.

This compression-set packer is particularly suitable for integrity testing of a liner when a permanent packer, or 'tie-back' packer, with a Polished Bore Receptacle (PBR) has been used. Once the permanent packer with the PBR has been set, a single trip can be made into the well to operate clean-up tools and perform an in-flow or negative test. The clean-up tools may be operated by relative rotation of the work string in the well-bore and further the work string can be slackened off so that the sleeve of the compression-set packer lands out on the PBR. This sets the compression-set packer above the PBR and seals the bore between the packers.

An in-flow or negative test can then be performed. Whereas such a negative test involves a "draw down" or reduced pressure effect upon the area of test e.g. a liner top to test the integrity of the cement seal, it may in certain instances instead be required to conduct a positive test which involves the application of high fluid pressure within the lower annulus, the effect of which could be to lift the packer required for conducting the test. In the case of a weight-set or compression packer, there may be insufficient drill pipe weight in the string to resist the high pressures developed during a positive test.

SUMMARY OF THE DISCLOSURE

One or more embodiments provide a tool enabling a positive wellbore integrity test to be conducted and a method for conducting such a test.

A tool in accordance with embodiments disclosed herein may provide a new sub to be incorporated in a work string and operably associated with a weight-set packer tool, wherein the sub is configured to selectively and reversibly deploy anchor means when a positive test is to be conducted, wherein the various operational configurations of the sub are controlled by use of circulation fluid and circulation valve means operable by introduction of an obturator into the circulation fluid and circulating it to a seat in the sub. Circulation valves are known generally in the field and the obturator or plug which is circulated to the valve seat is commonly referred to as a "ball" because that is a commonly used form, though in fact the obturator may have other forms e.g. a dart. Thus by using pressure applied by fluid circulated from the surface above the weight-set packer, a hydraulic hold-down anchor mechanism is enabled above the packer to reduce the risk of it becoming unset during a high pressure "positive" wellbore integrity test.

One or more embodiments of the present disclosure may provide a retrievable tool which can be operated by circulation valve means to selectively deploy anchor means but retain the ability to circulate fluid for other purposes when the anchor means is not deployed. Thus provision is made also for the hydraulic hold-down anchor mechanism to be disabled by a further use of a circulation valve within the new sub.

Unless otherwise stated, "circulation" means flow of fluid through the string from an upper or surface installation end of the string downhole, and it will be understood that such circulation, considered as "forward circulation" in the art, returns in the annulus around the string unless otherwise impeded, e.g. by means of a packer. References to "upstream" or "downstream" in relation to parts of the tool are to be understood in the context of forward circulation through the bore of the work string (or drill string if adapted for drilling with attached BHA) from a surface facility into the wellbore.

According to a first aspect of embodiments disclosed herein, there is provided a downhole tool adapted for attachment to a work string having an axial throughbore throughout its length, and comprising a tubular body having a corresponding axial bore, wherein the axial bore of the tubular body houses first and second inner sleeves, and the axial bore of the tubular body is configured to accommodate independent axial movement of the first and second sleeves within the axial bore to provide multiple fluid flowpath configurations through the tool, said configurations being selectively established by use of circulation fluid pressure and circulation valve means comprising a valve seat in each sleeve and an obturator to be introduced in the circulation fluid when a configuration change is required, and the tubular body has deployable anchor means recessed within a surface of the tubular body, said anchor means being deployable by effecting a fluid flowpath configuration change and thereby effecting a circulation fluid pressure change to cause the anchor means to deploy.

Said downhole tool may be configured as an anchor sub adapted to form pin and box standard tool joints within a work string which may be a string of jointed drill pipe.

The anchor means may be housed within stabiliser blades on the tubular body.

The anchor means may be retained in a stowed configuration for run in hole by use of mechanical, electromechanical or magnetic means, which means may be overcome or overridden by use of circulation fluid pressure when deployment of the anchor means is required.

The anchor means may be fluidically actuated anchor members located in radially oriented chambers within the tubular body which are provided with fluid communication channels which are fluidically connected with the axial bore for receiving circulation fluid selectively according to a flowpath configuration established by axial movement of at least one of said inner sleeves.

Each of the anchor members may be provided with a pad surface adapted to engage an external surface for anchoring purposes. The pad surface may be configured as a gripper pad with an engaging surface selected from the group consisting of a roughened surface, a ridged surface, a toothed surface, a grooved surface, a dimpled surface, and the like contoured or textured surfaces, and the pad material may be selected to increase frictional engagement with an external surface to which the tool is to be anchored.

The inner sleeves are generally tubular bodies configured to be axially movable within the bore of the tubular body which may be sized to limit the extent of permissible travel of at least one inner sleeve within the bore by a diameter reduction or shoulder or the like limit stop. The inner surface forming the bore of the tubular body may be configured by diameter changes to form sections adapted to cooperate with outer surfaces of the inner sleeves to define flow channels when the inner sleeves are appropriately positioned within the bore.

The first inner sleeve may comprise a valve seat at a leading end of the sleeve, which seat may be formed by a tapered reduction in diameter of the sleeve bore, towards the leading end, i.e. in the normal forward flow direction of circulation fluid, to accommodate a certain size range of obturators. The first inner sleeve may be provided with fluid by-pass channels upstream and downstream of the valve seat so that when the sleeve is axially displaced within the tubular body bore to a region of said axial bore that is of sufficiently greater diameter than the sleeve to form a by-pass annulus between the sleeve and tubular body sufficient to admit fluid flow, said fluid flow may pass around the captured obturator on the valve seat via said upstream channels, said by-pass annulus and said downstream channels to re-enter the axial bore of the tubular body.

The second inner sleeve may comprise a valve seat at a trailing end of the sleeve, which seat may be formed by a tapered reduction in diameter of the sleeve bore, in the normal forward flow direction of circulation fluid, to accommodate a larger size range of obturators than the first inner sleeve. This difference in taper size allows selective actuation of the first inner sleeve by a simple size choice of obturator to ensure that it passes through the second inner sleeve without being seated therein. The second inner sleeve may be provided with fluid by-pass channels upstream and downstream of the valve seat so that when the sleeve is axially displaced within the tubular body bore to a region of said bore that is of sufficiently greater diameter than the sleeve to form a by-pass annulus between the sleeve and tubular body sufficient to admit fluid flow, said fluid flow may pass around the captured obturator on the valve seat via said upstream channels, said by-pass annulus and said downstream channels to re-enter the sleeve bore.

The first and second inner sleeves may be held in a first configuration by releasable fastener means such as one or more shear pins designed to yield at a predetermined fluid pressure loading.

The first and second inner sleeves may be operated sequentially to perform an activation of function and a de-activation of function. The sequential operation permits a re-configuration of fluid flowpath through the tubular body of the tool by moving the sleeves so as to open or close flow channels in communication with ports on the outer surface of the tool.

At least one of the sleeves may be adapted to cooperate with a locking means such as a spring-loaded element positioned in the tubular body and configured to enter a recess in the sleeve when the sleeve is axially displaced to provide a new flowpath configuration, thereby locking the sleeve against any further axial movement and providing a "non-return" functionality. Other forms of locking means can be contemplated. It is also possible to adapt the sleeve to include a detent to cooperate with a shoulder or recess in the tubular body to provide "non-return" limit stop for the axially displaced inner sleeve. Various forms of spring-loaded elements are contemplated as capable of performing the non-return functionality to lock the axially displaced sleeve in a predetermined position within the tubular body. A spring-loaded retainer pin mounted in the tubular body and directed radially inwards to engage a corresponding recess in a surface of the inner sleeve is a suitable form. An axially directed longitudinal leaf-spring mounted in the tubular body and configured to have a biased free end ride over the surface of the inner sleeve and to drop into a reduced diameter section to engage a shoulder to provide a non-return stop would be another possibility for locking means to inhibit undesirable axial movement of the inner sleeve from an intended configuration set up.

The first and second inner sleeves may be positioned within the axial bore of the tubular body such that in at least one configuration allowing fluid flow through the tubular body, the anchoring means are sufficiently fluidically isolated from such flow so that the anchoring means cannot be deployed by changes in circulation fluid pressure. This is achievable by providing for fluid communication between internal and external parts of the tubular body.

In one embodiment, the fluidic isolation of the anchor means is achievable in one tool configuration by arranging that, by appropriate axial positioning of the inner sleeves, fluid communication channels which may be fluidically connected with the axial bore and serve to divert fluid to the anchor means for deployment thereof are occluded by a surface of the second inner sleeve following axial displacement thereof.

In an embodiment of the anchor sub, the tubular body comprises at least first and second sets of fluid ports providing a fluid communication path between the outside surface of the tubular body and the underside of the anchor means. These sets of fluid ports are situated on the downstream and upstream sides of the anchor means respectively. In certain configurations of the inner sleeves a fluid flow path can be completed between one of said sets of ports and the anchor means by provision of a section of reduced outer diameter on the respective inner sleeves to form in combination with an inner surface of the tubular body an annular fluid flow path. The arrangement being such that the first inner sleeve in a first position defining a first configuration of the anchor sub allows fluid communication from the outside of the tubular body through the downstream set of fluid ports and an annular section around said first inner sleeve to the underside of the anchor means, and in a subsequent configuration of the anchor sub prevents such fluid communication by virtue of axial displacement of said inner sleeve occluding the downstream set of fluid ports associated with the first inner sleeve. In said first configuration of the anchor sub, the upstream set of fluid ports is not in communication with the underside of the anchor means. The first configuration is typically a tool setting for run in hole prior to activation of the tool.

In a second configuration of this embodiment of the anchor sub, following a "ball drop" event to displace the first inner sleeve axially from its first position, the downstream set of fluid ports to the outside of the tubular body are occluded. In this configuration, due to capture of the obturator "ball" on its seat within the first inner sleeve, pressure increase within the bore transmitted via said fluid communication channels activates displacement of the anchor means radially outwards with respect to the tubular body to adopt an anchoring position in contact with a surface external to the anchor sub (typically an internal surface of casing).

In a third configuration of this embodiment of the anchor sub, following a further "ball drop" event to displace the second inner sleeve axially from its first position, the upstream set of fluid ports to the outside of the tubular body are allowed to communicate with the underside of the anchor means, whereby pressure equalisation between the outside of the anchor sub and the underside of the anchor means takes place and there is no longer any pressure to drive the anchor means towards deployment. Annulus pressure may urge return of the anchor means from the deployed position.

In the third configuration of this embodiment of the anchor sub, a locking means provided in the anchor sub tubular body is activated to restrain the second inner sleeve from further axial displacement, thereby providing additional assurance that pressure changes within the anchor sub cannot be transmitted to the anchor means to effect unintentional deployment thereof, even if for example fluid circulation is reversed for operational reasons during a subsequent use of the work string to operate other tools downhole or to accomplish a different task or procedure in the wellbore.

In a further aspect of embodiments disclosed herein, there is provided a tool assembly for use in conducting wellbore integrity tests comprising a compression packer tool and an anchor sub operatively connected together and adapted for attachment to a work string having an axial throughbore throughout its length, wherein the anchor sub comprises a tubular body having a corresponding axial bore, wherein the axial bore of the tubular body houses first and second inner sleeves, and the axial bore of the tubular body is configured to accommodate independent axial movement of the first and second sleeves within the axial bore to provide multiple fluid flowpath configurations through the tool, said configurations being selectively established by use of circulation fluid pressure and circulation valve means comprising a valve seat in each sleeve and an obturator to be introduced in the circulation fluid when a configuration change is required, and the tubular body has deployable anchor means recessed within a surface of the tubular body, said anchor means being deployable by effecting a fluid flowpath configuration change thereby effecting a circulation fluid pressure change to cause the anchor means to deploy. In a typical use the compression packer tool and the anchor sub are connected into the work string by standard tool joints such that the anchor sub is operably linked, e.g. in tandem, with the compression set packer which forms the leading part of the tool assembly on run-in hole. The spacing between the anchor sub and the compression packer tool may be determined by operational requirements, and indeed the tool assembly of embodiments disclosed herein may be configured in a single tool embodiment providing both compression packer with hold-down anchor functionality.

The aforesaid tool assembly for use in conducting wellbore integrity tests may incorporate some or all of the features of the anchor sub tool according to one aspect of embodiments disclosed herein described herein before.

In a still further aspect of embodiments disclosed herein, there is provided a method of conducting a wellbore integrity test, specifically a positive test, comprising introducing a tool assembly comprising a compression packer and an anchor sub operatively connected therewith on a work string to a test zone of a cased or lined wellbore, circulating an obturator to a first circulation valve means provided in the anchor sub to effect a configuration change in the anchor sub to admit fluid to anchor means therein, setting the packer by setting down weight using the work string, pressuring up with circulation fluid to effect deployment of anchor means in the anchor sub, and increasing pressure to a value sufficient to complete a positive test.

After the test is successfully completed, the method comprises the further steps of bleeding off pressure, and unsetting the compression packer by lifting the workstring sufficiently, and circulating a further obturator to a second circulation valve means provided in the anchor sub to effect a configuration change in the anchor sub to inhibit pressure differentials developing that would be capable of re-deploying the anchor means therein.

According to a still further aspect of embodiments disclosed herein, there is provided an anchor sub tool for deployment in a work string to serve as a retrievable anchor in a wellbore, which comprises a tubular body configured to be connected into a work string, which tubular body houses first and second circulation valve means, said valve means being disposed in first and second sleeves axially movable within the tubular body to provide sequential tool configurations, and the tubular body further comprises anchor means movable from a stowed position in chambers within a side wall of the tubular body and a deployed position extending beyond the side wall of the tubular body by fluid pressure, and the tubular body further comprises first and second sets of ports permitting fluid flow between the exterior of the tubular body, via internal channels forming a fluid pathway with the chambers, wherein the first and second inner sleeves are positioned within the axial bore of the tubular body such that in at least one configuration allowing fluid flow through the tubular body, the anchoring means are sufficiently fluidically isolated from such flow due to the axial positioning of the sleeves that the anchoring means cannot be deployed by changes in fluid pressure.

At least one inner sleeve may be configured to cooperate with locking means providing a non-return from an axially displaced position wherein the anchoring means are fluidically isolated from pressure changes arising from circulation of fluid through the work string.

The anchor means may be housed within stabiliser blades on the tubular body.

The anchor means may be retained in a stowed configuration for run in by use of mechanical, electromechanical or magnetic means, which means may be overcome or overridden by use of circulation fluid pressure when deployment of the anchor means is required.

The anchor means may comprise anchor members movable in response to increased circulation fluid pressure within the tubular body.

Each of the anchor members may be provided with a pad surface adapted to engage a surface external to the tool for anchoring purposes. The pad surface may be configured as a gripper pad with an engaging surface selected from the group consisting of a roughened surface, a ridged surface, a toothed surface, a grooved surface, a dimpled surface, and the like contoured surfaces, and the pad material may be selected to increase frictional engagement with an external surface to which the tool is to be anchored.

BRIEF DESCRIPTION OF THE DRAWINGS

Embodiments disclosed herein will now be illustrated by way of example with reference to particular embodiments shown in the accompanying drawings in which.

DETAILED DESCRIPTION

Figure 1:
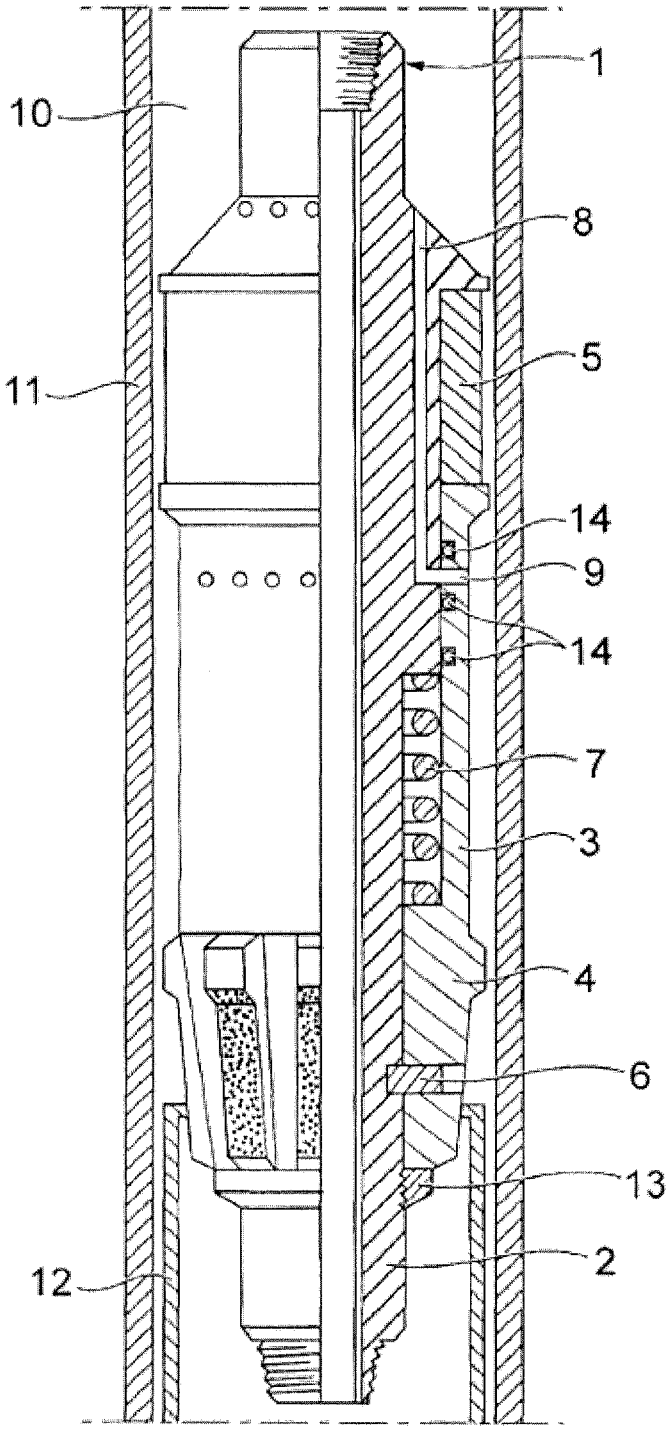
Fig. 1 (Prior Art)
FIG. 1 illustrates a compression or weight-set packer tool as described in our U.S. Pat. No. 6,896,064 B2 being introduced to a well bore in proximity to a liner top.

Referring firstly to FIG. 1, a compression or weight-set packer tool is generally depicted at 1 and comprises a packer body 2 and an outer compression sleeve 3 which is moveable in relation to the body 2. The body 2 is mounted on a work string (not shown), typically a drill pipe. The outer compression sleeve 3 has or is associated with a shoulder 4 which may be a liner top mill. The outer compression sleeve 3 is positioned substantially below one or more packer elements 5. The one or more packer elements 5 are typically made from a moulded rubber material. The outer sleeve 3 also has a retainer ring 13.

The outer sleeve 3 is mechanically attached to the body 2 of the tool 1 by one or more shear fasteners 6, and is biased by a spring 7. The body 2 of the tool 1 has an integral bypass channel 8 through which fluid can bypass the area around the packer elements 5, by flowing through the body 2 of the tool 1. The fluid then flows through a bypass port 9 in the sleeve 3. The integral bypass ports 9 and channel 8 are open when the tool is being advanced through a well bore 10, that is, before the tool 1 is set, and increase the fluid bypass area of the tool 1.

The tool 1 is mounted on a work string (not shown) and run into a pre-formed well bore 10. The pre-formed well bore 10 is lined by a casing string 11 and liner 12. The packer tool 1 is run through the bore 10 until the shoulder 4 rests on the top of the liner 12. Weight is then set down on the work string and attached tool 1, until the one or more shear fasteners 6, yield.

Shearing of the shear fasteners 6, releases the sleeve 3 from the body 2 of the tool 1, and allows the sleeve 3 to be moved relative to the body 2, by virtue of further weight set on the tool 1. In the depicted tool, shearing of the shear fasteners 6 allows the outer compression sleeve 3 to move in an upward direction relative to the body 2, although it will be appreciated that in an alternative embodiment the packer elements 5 may be located substantially below the sleeve 3 and the sleeve 3 may move in a downward direction relative to the tool body 2. As the outer compression sleeve 3 moves relative to the body 2, it compresses the one or more packer elements 5. Compression of the packer elements 5 distorts them from being fundamentally long and oblong in shape to squat and square in shape. As a result of the change in volume of the packer elements 5 the elements 5 come into contact with the casing 11 thereby sealing the annulus between the casing 5 and the tool 1.

Figure 2:
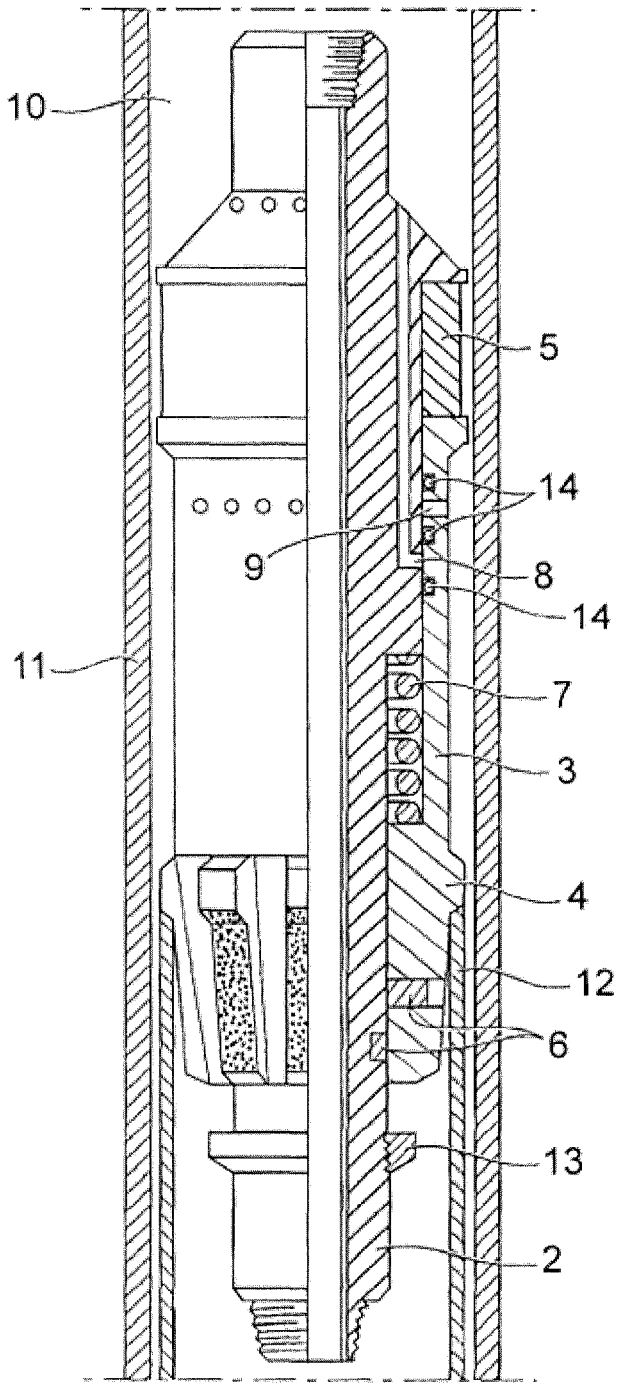
Fig. 2 (Prior Art)
FIG. 2 illustrates the packer tool of FIG. 1 with set packer elements, and in position at the liner top.

This can be seen in more detail in FIG. 2, where the tool 1 is weight-set on the liner top 12 and the packer elements 5 are set. Movement of the compression sleeve 3 relative to the tool 1 causes the bypass port 9 to move out of alignment from the bypass channel 8 via the actions of seals 14. This prevents fluid from circulating through the ports 9 and channel 8.

Figure 3:
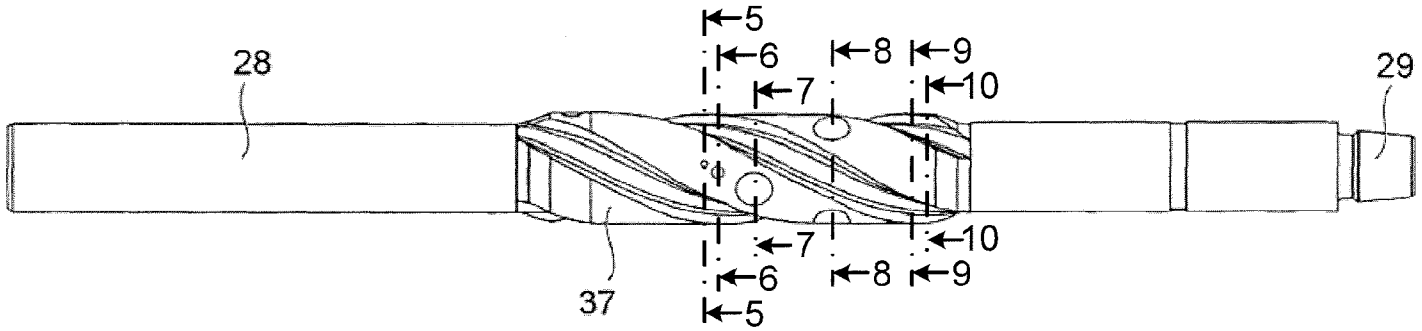
FIG. 3 illustrates a longitudinal side view of an anchor sub in accordance with embodiments disclosed herein suitable for use with a compression or weight set tool such as that shown in FIGS. 1 and 2 and various sectional views in FIGS. 5-10 through the operative components of the anchor sub.
Figure 10:
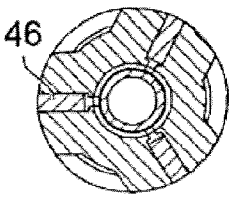
FIG. 10 illustrates a sectional view through ports of the anchor sub.
Figure 3A:
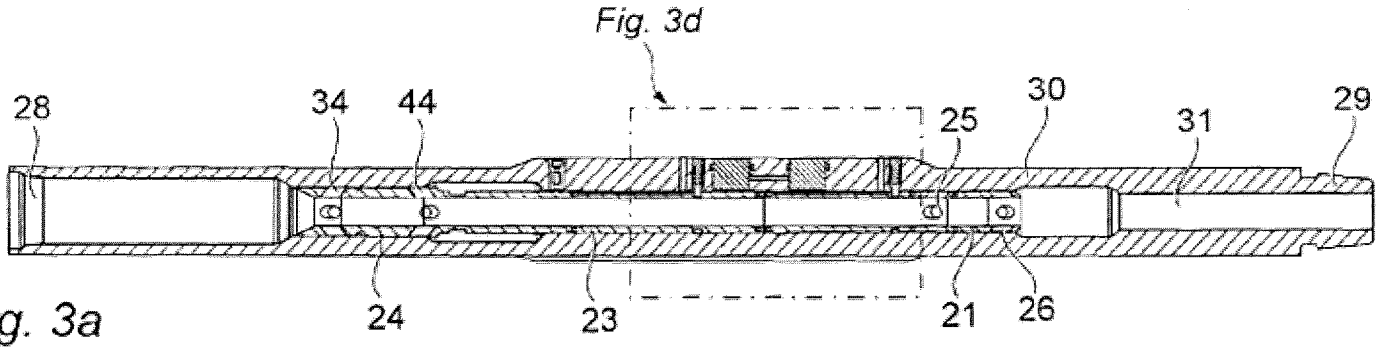
FIG. 3*a* illustrates in longitudinal section an anchor sub in accordance with embodiments disclosed herein in "run-in" configuration prior to setting of the tool, wherein the inner sleeves are both in a first configuration set to allow circulation fluid flow straight through the tool.
Figure 3B:
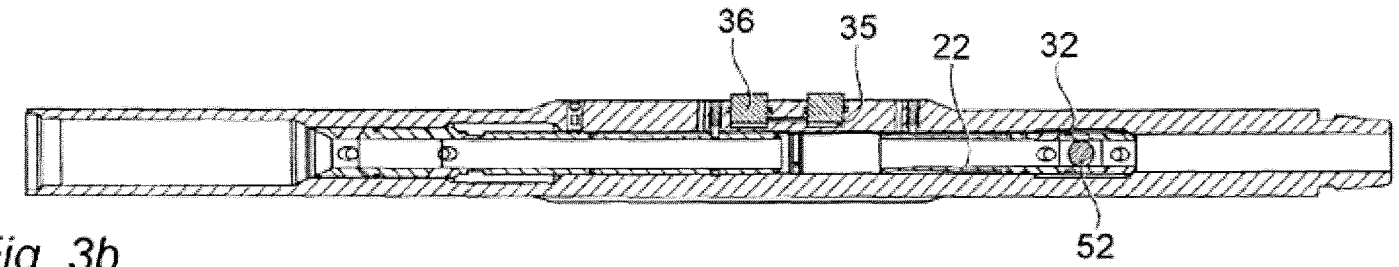
FIG. 3*b* illustrates in longitudinal section the anchor sub of FIG. 3*a* in an operational configuration whereby anchoring means are deployed by means of a sequence comprising a ball-drop, pressure-up, axial displacement of a first inner sleeve, and circulation fluid diversion to displace anchor members radially.
Figure 3C:
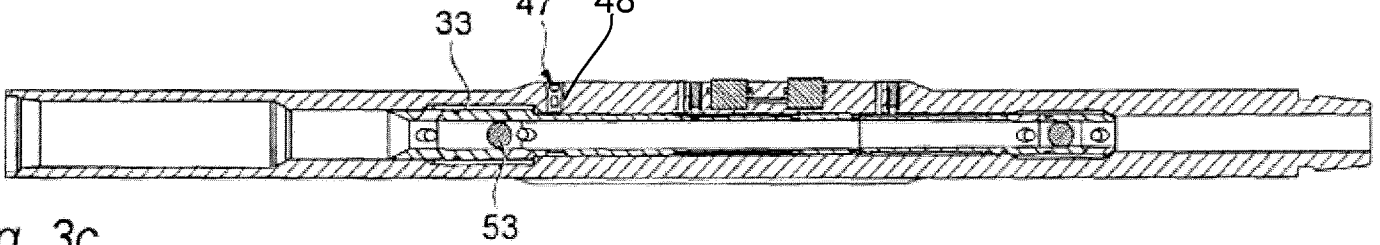
FIG. 3*c* illustrates in longitudinal section the anchor sub of FIGS. 3*a* & 3*b* in a de-activated configuration whereby anchoring means are withdrawn and a further circulation flow-through configuration is attained by means of a sequence comprising a further ball-drop, pressure-up, and axial displacement of a second inner sleeve to allow resumption of circulation fluid flow straight through the tool.
Figure 4:
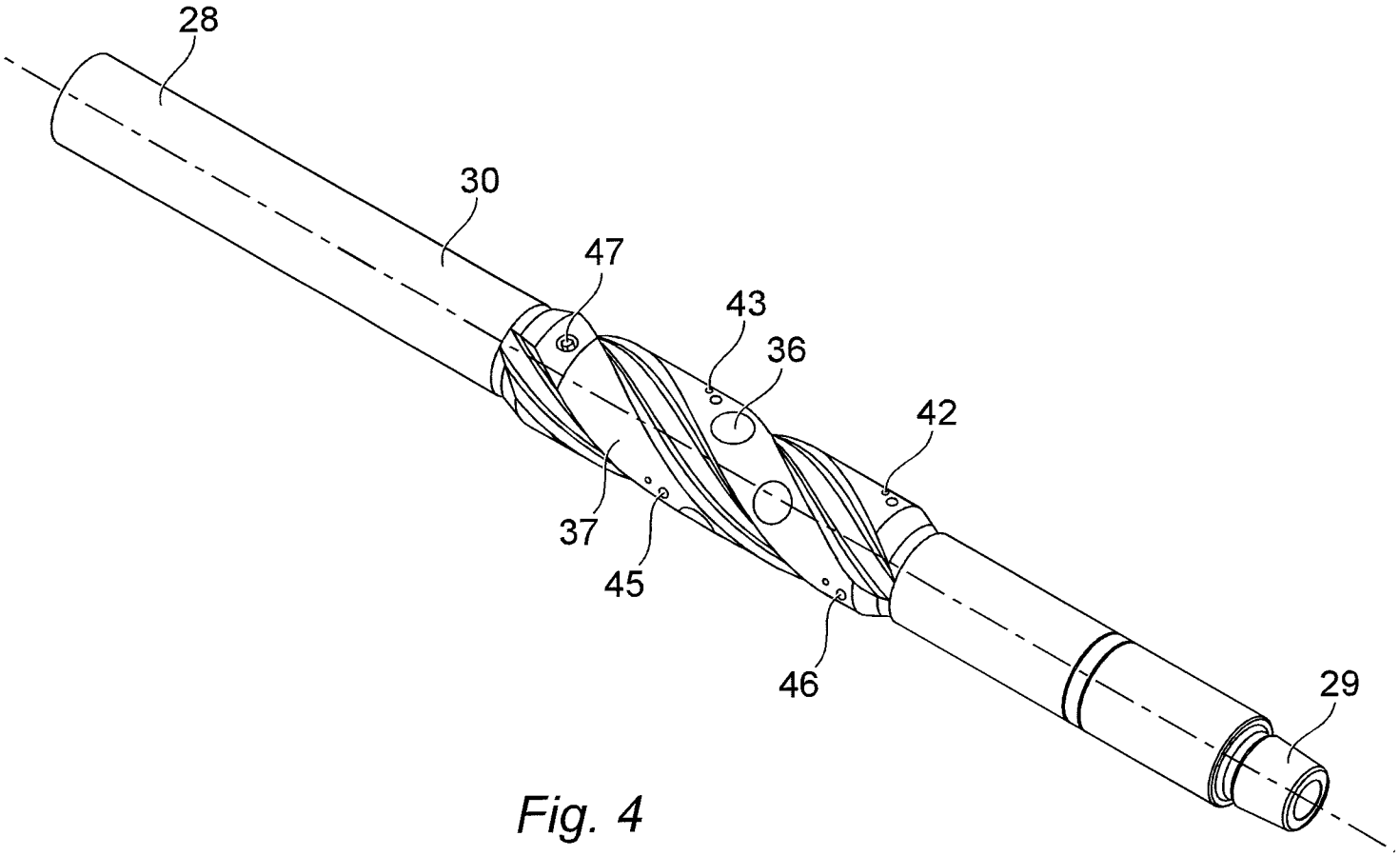
FIG. 4 illustrates a perspective view of an embodiment of an anchor sub according to embodiments disclosed herein.

Referring mainly to FIGS. 3*a*, 3*b*, and 3*c*, there are shown three sequential operational configurations of an anchor sub with fluidically activated slips for use with a compression packer such as that illustrated in FIGS. 1 and 2 and described above. The anchor sub is operatively connected to the compression packer and designed to resist axial displacement of the compression packer after it has been set, particularly for the purpose of conducting a positive wellbore integrity test. For ease of illustration and viewing of other parts, the blades of the stabiliser are shown as straight, but in practice the blades normally would be formed to have a spiral configuration as shown in FIGS. 3 and 4.

The FIGS. 3*a*, 3*b*, and 3*c* illustrate respectively (a) a tool configuration wherein the tool is initially configured for flow of circulation fluid through the work string with an unobstructed axial through bore, and is thereby ready for run-in hole, (b) a subsequent tool configuration wherein the tool is activated by circulation of an obturator to allow pressure up for deployment of anchor means, and (c) a subsequent tool configuration wherein the tool is deactivated by circulation of a further obturator to achieve a neutralisation of pressure differentials with respect to fluid pressure felt by the underside of the anchor means, so that the anchor means may not be re-deployed no matter what changes in circulation fluid pressure may take place during any subsequent operational use of the work string, even where fluid circulation is reversed.

Referring now to FIG. 3*a*, an anchor sub has a tubular body 30 having an axial bore 31, and box and pin ends 28, 29 adapted to form a standard tool joint with components of a work string e.g. drill pipe (not shown) and in particular with a compression or weight-set packer 1 such as that illustrated in FIGS. 1 and 2.

The tubular body 30 is configured to house first and second inner sleeves respectively 22 and 23, capable of independent axial displacement within the axial bore 31 to provide multiple fluid flowpath configurations through the tubular body. The tubular body 30 has portions of axial bore that are of wider bore than is required to accommodate the inner sleeves 22 and 23 in a close sliding fit within the tubular body, in order to form fluid flow by-pass channels 32 and 33, the purpose of which will be elaborated upon hereinbelow.

Figure 3D:
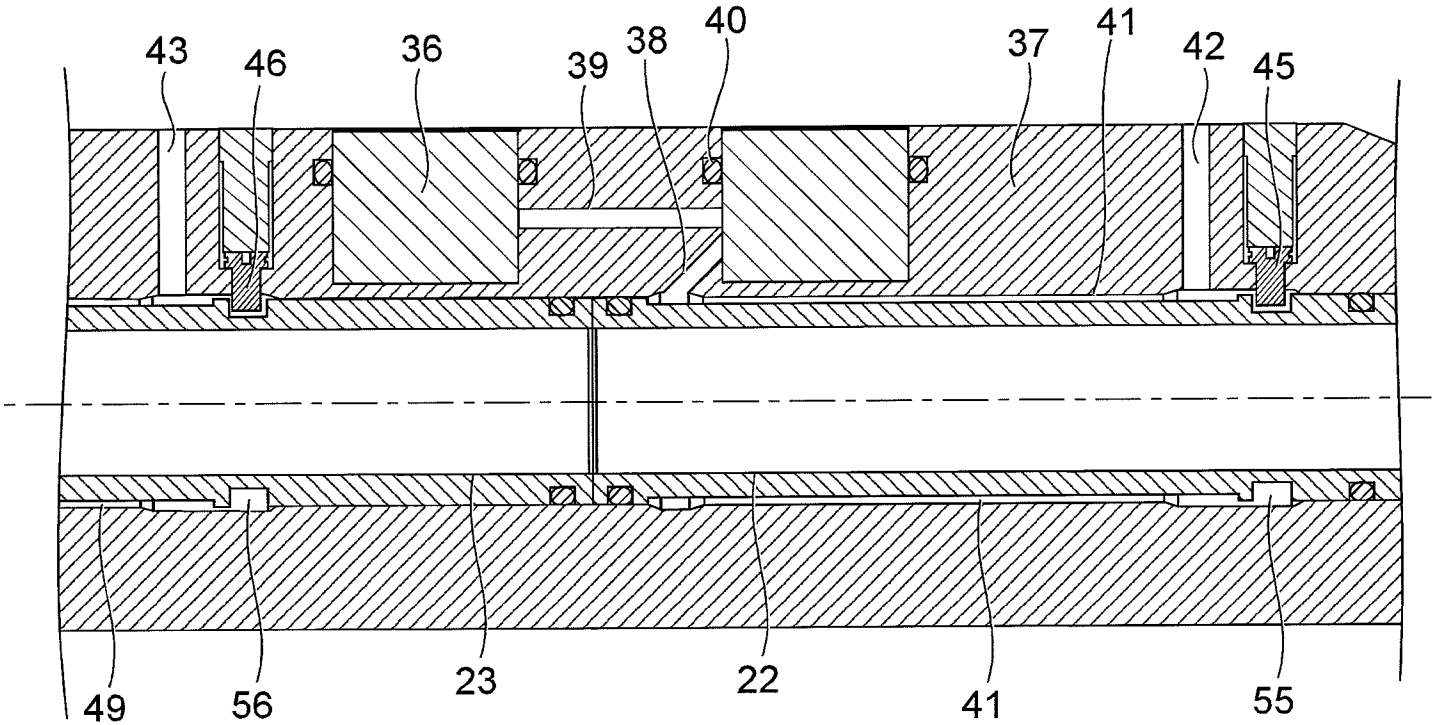
FIG. 3*d* illustrates an enlarged sectional view of part of the anchor sub of FIG. 3*a* focussing on the fluidically deployable anchor means in particular showing detail of fluid pressure equalisation ports, fluid communication channels allowing circulation fluid diversion to permit deployment of the anchor means, and shear fastener means for retention of the inner sleeves in the first "run-in" configuration before a ball drop.

The tubular body 30 is further configured to house anchor means in the form of fluid driven anchor members 36 movable from a stowed position in chambers 35 within a side wall of the tubular body, as shown here within a stabiliser blade 37 and a deployed position extending beyond the side wall of the tubular body. The chambers 35 are interconnected by fluid channel 39, and connected to the axial bore of the tubular body by fluid channel 38 (as illustrated in FIG. 3*d*). Seals 40 inhibit fluid leakage from the chambers. The surface of each anchor member 36 is configured as a gripper pad with a ridged or grooved surface.

The tubular body further comprises first and second sets of ports 42, 43 permitting fluid flow between the exterior of the tubular body and the chambers 35 when the tool is appropriately configured for such fluid flow.

Fluid flow is controlled by the appropriate axial positioning of the inner sleeves 22, 23. Axial positioning of the inner sleeves for different configurations of the tool is achieved by use of shear fasteners and circulation valves. In a normal orientation of the tool at least when set up for run-in hole in a work string the first or leading inner sleeve 22 is directly below the second or trailing inner sleeve 23, but it will be understood that wellbores may deviate considerably from the vertical towards the horizontal as the wellbore is extended laterally into a formation to reach hydrocarbon deposits. Accordingly in this description, reference will be made to the first sleeve 22 rather than the "lower sleeve", and to the second sleeve 23 rather than the "upper sleeve".

The first inner sleeve 22 is provided with a tapered bore defining a valve seat 21 at a leading end of the sleeve, to accommodate a certain size range of obturators to form a circulation valve means to obstruct fluid flow through the sleeve 22. The first inner sleeve 22 is provided with fluid by-pass channels 25, 26 respectively upstream and downstream of the valve seat 21, so that when the sleeve is axially displaced within the tubular body to a region of the axial bore 31 that is of sufficiently greater diameter than the sleeve 23 to form an annular by-pass channel 32 between the sleeve 23 and tubular body 30 sufficient to admit fluid flow, said fluid flow may pass around the captured obturator 52 on the valve seat 21 via said upstream channels 25, said by-pass channel 32 and said downstream channels 26 to re-enter the axial bore 31 of the tubular body.

The second inner sleeve 23 is provided with a tapered bore defining a valve seat 24 at a trailing end of the sleeve to accommodate a larger size range of obturators than the first inner sleeve 22 to form a circulation valve means to obstruct fluid flow through the sleeve 23. The second inner sleeve 23 is provided with fluid by-pass channels 34, 44 respectively upstream and downstream of the valve seat 24 so that when the sleeve is axially displaced within the tubular body to a region of the axial bore 31 that is of sufficiently greater diameter than the sleeve to form an annular by-pass channel 33 between the sleeve and tubular body sufficient to admit fluid flow, whereby in an appropriate axial position of the sleeve 23 within the tubular body 30 fluid flow may pass around the captured obturator 53 on the valve seat 24 via said upstream channels 34, said by-pass channel 33 and said downstream channels 44 to re-enter the sleeve bore which is in communication with the axial bore 31.

The first and second inner sleeves are held in a first configuration for run-in by releasable fastener means such as one or more shear pins 45, 46 positioned at intervals around the tubular body and engaging with a corresponding recess 55, 56 in the respective sleeves, which pins are designed to yield at a predetermined fluid pressure loading achievable using the circulation valve means to allow release of the respective sleeve to achieve a fluid flow path configuration change in the tool.

The second inner sleeve 23 is adapted to cooperate with a locking means consisting of a spring-loaded lock down pin element 47 positioned in the tubular body and configured to enter a recess 48 in the sleeve 23 when the sleeve is axially displaced to change fluid flowpath configuration, thereby locking the sleeve against any further axial movement and providing a "non-return" functionality, even in the instance when fluid circulation is reversed.

In a typical use of the anchor sub tool 30, for the purpose of conducting a positive wellbore integrity test in a cased or lined wellbore, a tool assembly comprising a compression set packer such as that illustrated in FIGS. 1 & 2 is operably connected to the anchor sub using standard tool joints and the assembly is deployed in a work string having an axial bore throughout for circulation of fluid such that the anchor sub is located above the compression set packer.

Since the operation of a compression set packer is described above with reference to FIGS. 1 & 2, the following description focuses on the operational use of the anchor sub tool 30 for conducting a positive wellbore integrity test using such a packer.

Referring to FIGS. 3*a*, 3*b*, 3*c* and 3*d*, and especially FIGS. 3*a* & 3*d* an anchor sub 30 is set in a flow-through pathway configuration wherein the first inner sleeve 22 is in a first position and held there by provision of several shear pins 45 (one visible) positioned at intervals around the tubular body and engaging with a corresponding annular recess 55 in the inner sleeve 22 to restrain axial movement thereof. Similarly, the second inner sleeve 23 is in a first position and held there by provision of several shear pins 46 (one visible) positioned at intervals around the tubular body and engaging with a corresponding annular recess 56 in the inner sleeve 23 to restrain axial movement thereof.

Figure 9:
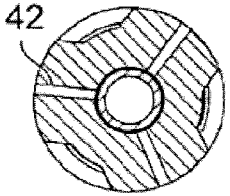
FIG. 9 illustrates a sectional view through shear pins of the anchor sub.
Figure 8:
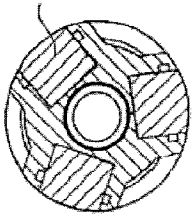
FIG. 8 illustrates a sectional view through anchor members of the anchor sub.
Figure 7:
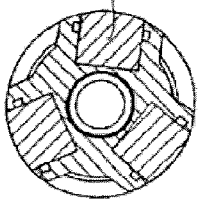
FIG. 7 illustrates a sectional view through anchor members of the anchor sub.
Figure 6:
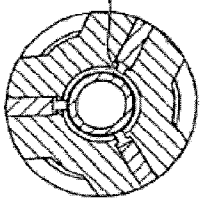
FIG. 6 illustrates a sectional view through ports of the anchor sub.

In the run-in position illustrated in FIG. 3*a*, there is no fluid pressure differential sufficient to deploy anchor members 36 and notably, as illustrated in sectional view in FIG. 9 fluid communication between the outer surface of the sub to the underside of the anchor members 36 in the chambers 35 is allowed by the presence of the ports 42 in the tubular body 30 through annular channel 41 and fluid channel 38.

Once the test zone has been reached an obturator in the form of a ball 52 is circulated to the valve seat 21.

Since the fluid circulation through the inner sleeve 22 is now obstructed by the ball 52 seated on the valve seat 21, circulation fluid pressure can be increased to a value at which the shear pin fasteners 45 yield allowing axial displacement of the inner sleeve 22 to the position illustrated in FIG. 3*b*, which changes the fluid flowpath within the tubular body by preventing fluid exchange via the port 42, and permits the internal pressure to build and force fluid pressure upon the underside of the anchor members 36 via fluid channel 38 into chambers 35 which receive equal pressure due to interconnecting channel 39, leading to deployment of the anchor members 36 until contact with an exterior surface e.g. inner surface of casing in the test zone. This movement of the inner sleeve 22 also restores the circulation fluid flow through the work string via the by-pass channels 25, and 26 in combination with the annular by-pass channel 32.

The compression packer can be set by setting down weight using the workstring as described above with reference to FIGS. 1 and 2.

Circulation fluid pressure can then be increased to the required test pressure with reduced risk of the compression packer lifting under the applied pressure since the anchor members 36 are already deployed above the packer and maintained thus by the forward circulation fluid pressure applied from the surface through the axial bore within the anchor sub to the underside of the anchor members 36.

Subsequently upon completion of the positive test, the high pressure is bled off according to industry practice, and the compression packer is unset by lifting the work string sufficiently.

A larger diameter ball 53 sized to be captured in the valve seat 24 of the second inner sleeve 23 is circulated to said valve seat 24, whereupon a pressure increase can be used to overcome the shear pin fasteners 46 holding the second inner sleeve 23 in position and cause it to be displaced axially to the position illustrated in FIG. 3*c*, whereupon circulation flow around the captured ball 53 on the valve seat 24 is restored via the by-pass channels 34, and 44 in combination with the annular by-pass channel 33. In this position a spring-loaded lock down pin 47 mounted in the tubular body 30 engages a recess 48 in the outer surface of the second inner sleeve 23 thereby locking that sleeve against any further axial movement and providing a "non-return" functionality.

Figure 5:
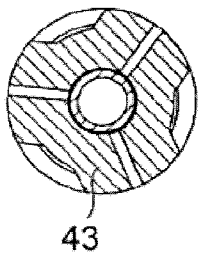
FIG. 5 illustrates a sectional view through shear pins of the anchor sub.

In this locked position the purpose is two-fold: firstly pressure-equalisation across the anchor members 36 is enabled as illustrated in sectional view in FIG. 5 due to fluid communication between the outer surface of the anchor sub 30 to the underside of the anchor members 36 in the chambers 35 via the ports 43 in the tubular body 30 through annular channel 49 and fluid channel 38. Secondly the fluid communication channels 38 are occluded by the second sleeve preventing fluid flow from the bore to the chambers 35.

In this way the anchor tool is effectively switched off and cannot be re-activated during subsequent downhole operations or during pull out from the well.

The invention claimed is:

1. A downhole comprising:

a tubular body having an axial bore, wherein the axial bore of the tubular body houses first and second inner sleeves, and the axial bore of the tubular body is configured to accommodate independent axial movement of the first and second sleeves within the axial bore to provide multiple fluid flowpath configurations through the tool;

said fluid flowpath configurations being selectively established by use of circulation fluid pressure and a first circulation valve in the first inner sleeve and a second circulation valve in the second inner sleeve, each valve comprising a valve seat and an obturator to be introduced in the circulation fluid when a fluid flowpath configuration change is required, wherein the tubular body has deployable anchor means recessed within a surface of the tubular body, said anchor members being deployable by effecting a fluid flowpath configuration change and thereby effecting a circulation fluid pressure change within the tool to cause the anchor means to deploy, wherein the first inner sleeve comprises a valve seat at a leading end of the sleeve, which seat is formed by a tapered reduction in diameter of the sleeve bore, and fluid by-pass channels are provided in the inner sleeve upstream and downstream of the valve seat.

2. The downhole tool as claimed in claim 1, wherein the second inner sleeve comprises a valve seat at a trailing end of the sleeve, which seat is formed by a tapered reduction in diameter of the sleeve bore that is sized to allow circulation of an obturator through the valve seat of the second inner sleeve to be captured in the first inner sleeve, and said valve seat of the second inner sleeve is provided with fluid by-pass channels upstream and downstream of the valve seat.

3. The downhole tool according to claim 1, wherein the first and second inner sleeves are held in position for run in hole by releasable fastener means designed to yield at a predetermined fluid pressure loading.

4. The downhole tool according to claim 1, wherein the first and second inner sleeves are positioned within the axial bore of the tubular body such that in at least one configuration allowing fluid flow through the tubular body, the anchoring members are sufficiently fluidically isolated from such flow that the anchoring means cannot be deployed by changes in circulation fluid pressure.

5. The downhole tool according to claim 4, wherein the fluidic isolation of the anchor members is achievable in one tool configuration by arranging that, by appropriate positioning of the inner sleeves, fluid communication channels which are fluidically connected with the axial bore and serve to divert fluid to the anchor means for deployment thereof are occluded by a surface of the second inner sleeve following axial displacement thereof.

6. An anchor sub comprising:

deployable anchor members recessed within a surface of the tubular body; and at least first and second sets of fluid ports providing a fluid communication path between an outside surface of the tubular body and the underside of the anchor members, wherein the sets of fluid ports are situated on the downstream and upstream sides of the anchor members respectively, and wherein first and second inner sleeves are selectively axially movable within the tubular body to provide multiple fluid flowpath configurations through the tool, said multiple fluid flowpath configurations being selectively established by use of circulation fluid pressure and a first circulation valve in the first inner sleeve and a second circulation valve in the second inner sleeve, each valve comprising a valve seat and an obturator to be introduced in the circulation fluid when a fluid flowpath configuration change is required.

7. The anchor sub according to claim 6, wherein a lock is provided in the anchor sub tubular body to restrain the second inner sleeve from further axial displacement once the second inner sleeve has been axially moved by use of the second circulation valve in the second inner sleeve.

* * * * *